US008516964B2

(12) United States Patent
Heitmann et al.

(10) Patent No.: US 8,516,964 B2
(45) Date of Patent: Aug. 27, 2013

(54) CARTRIDGE

(75) Inventors: Thomas Heitmann, Unterlüss (DE); Klaus-Achim Kratzsch, Hermannsburg (DE); Michael Vagedes, Hermannsburg (DE)

(73) Assignee: Rheinmetall Waffe Munition GmbH, Unterluss (DE)

( * ) Notice: Subject to any disclaimer, the term of this patent is extended or adjusted under 35 U.S.C. 154(b) by 315 days.

(21) Appl. No.: 12/674,641

(22) PCT Filed: Jul. 25, 2008

(86) PCT No.: PCT/EP2008/006108

§ 371 (c)(1),
(2), (4) Date: Aug. 16, 2011

(87) PCT Pub. No.: WO2009/024245

PCT Pub. Date: Feb. 26, 2009

(65) Prior Publication Data

US 2011/0290143 A1 Dec. 1, 2011

(30) Foreign Application Priority Data

Aug. 21, 2007 (DE) ..... 10 2007 039 532

(51) Int. Cl.
*F42B 5/16* (2006.01)

(52) U.S. Cl.
USPC ..... 102/466; 102/430

(58) Field of Classification Search
USPC ..... 102/430, 464–472
See application file for complete search history.

(56) References Cited

U.S. PATENT DOCUMENTS

| | | | | |
|---|---|---|---|---|
| 2,399,398 | A * | 4/1946 | Smith | 102/430 |
| 3,148,620 | A | 9/1964 | Jacobson et al. | |
| 4,098,193 | A * | 7/1978 | Schroeder | 102/435 |
| 4,159,678 | A | 7/1979 | Luther et al. | |
| 4,887,534 | A | 12/1989 | Dickovich et al. | |

(Continued)

FOREIGN PATENT DOCUMENTS

| | | |
|---|---|---|
| DE | 11 99 670 | 8/1965 |
| DE | 7234535 U1 | 3/1976 |

(Continued)

OTHER PUBLICATIONS

International Search Report issued in corresponding application PCT/EP2008/006108, completed Dec. 19, 2008 and mailed Jan. 7, 2009.

*Primary Examiner* — Michael David
(74) *Attorney, Agent, or Firm* — Griffin & Szipl, P.C.

(57) ABSTRACT

The invention relates to a cartridge having a propellant charge casing at least partially filled with a propellant charge powder, and a projectile part connected on a front of the propellant charge casing, wherein the propellant charge casing comprises a casing cover, a casing sheath and a casing base, and the casing sheath is connected to the projectile part via the casing cover and to the casing base via a spring steel sheet. In order to achieve different amounts of propellant charge powder filled into the same propellant charge casing without igniting the propellant charge at undesirable blast waves, a sack-shaped container that is completely filled with the respective amount of propellant charge powder is disposed inside the propellant charge casing so that the container, and thus also the propellant charge powder, extends in the direction of the central longitudinal axis of the cartridge.

9 Claims, 3 Drawing Sheets

(56) References Cited

U.S. PATENT DOCUMENTS

| | | | | |
|---|---|---|---|---|
| 5,090,323 | A | 2/1992 | Kallevig et al. | |
| 5,698,815 | A * | 12/1997 | Ragner | 102/502 |
| 6,354,183 | B1 | 3/2002 | Hallqvist | |
| 6,408,764 | B1 * | 6/2002 | Heitmann et al. | 102/469 |
| 6,725,781 | B2 * | 4/2004 | Niemeyer et al. | 102/472 |
| 6,748,870 | B2 * | 6/2004 | Heidenreich et al. | 102/431 |
| 7,360,486 | B2 * | 4/2008 | Alculumbre et al. | 102/244 |
| 7,913,625 | B2 * | 3/2011 | Mutascio | 102/431 |
| 8,136,451 | B2 * | 3/2012 | Mutascio | 102/431 |
| 8,146,502 | B2 * | 4/2012 | Mutascio | 102/431 |
| 2006/0254448 | A1 * | 11/2006 | Alculumbre et al. | 102/244 |
| 2011/0259225 | A1 * | 10/2011 | Baumann et al. | 102/202 |

FOREIGN PATENT DOCUMENTS

| | | | |
|---|---|---|---|
| DE | 26 41 665 | A | 3/1978 |
| DE | 197 41 842 | A1 | 3/1999 |
| DE | 198 21 050 | A1 | 11/1999 |
| DE | 198 52 360 | C2 | 10/2001 |
| DE | 697 21 037 | T2 | 3/2004 |

* cited by examiner

CARTRIDGE

This is a National Phase Application in the United States of International Patent Application No. PCT/EP2008/006108 filed Jul. 25, 2008, which claims priority on German Patent Application No. DE 10 2007 039 532.0, filed Aug. 21, 2007. The entire disclosures of the above patent applications are hereby incorporated by reference.

FIELD OF THE INVENTION

The invention relates to a cartridge having a propellant charge casing that is at least partially filled with propellant charge powder and having a projectile part, which is connected to the propellant charge casing at the front end.

BACKGROUND OF THE INVENTION

In cartridges such as these, the propellant charge casing normally comprises a casing cover, a casing sheath, and a casing base composed of metal, wherein the casing sheath, which is composed of a combustible material, is connected, on the one hand, via the casing cover to the projectile part and, on the other hand, via a spring plate and a locking ring to the casing base.

Propellant charge casings, of the type mentioned above, can be used both for live cartridges and for practice cartridges.

A relatively low projectile weight is also a critical factor, in addition to the production of a projectile that is as cost-effective as possible, in particular, for the production of a cost-effective kinetic-energy practice munition. A reduced projectile weight also makes it possible to greatly reduce the propulsion power and the amount of propellant charge power. A greatly reduced amount in the drive volume means, however, an uneven distribution of the poured powder in the cartridge after loading, if the composition volume remains the same. This is associated with undesirable pressure waves during ignition.

The invention is based on the object of avoiding the disadvantage mentioned above.

SUMMARY OF THE INVENTION

According to the present invention, this object is achieved by the features of a cartridge having a propellant charge casing (2) that is at least partially filled with propellant charge powder (13) and having a projectile part (3) that is connected to the propellant charge casing (2) at the front end, wherein the propellant charge casing (2) has a casing cover (7), a casing sheath (8) and a casing base (9), and wherein the casing sheath (8) is connected, on the one hand, via the casing cover (7) to the projectile part (3) and, on the other hand, via a spring plate (10) to the casing base (9), and the propellant charge powder (13) is arranged in a container (14) that is in the form of a sack and extends in the direction of the longitudinal axis (100) of the cartridge (1).

Further particularly advantageous refinements of the invention are disclosed in the additional embodiments.

For example, in accordance with a second embodiment of the present invention, the first embodiment is modified so that the end area (15) at the base end is attached to the casing base (9) by means of the spring plate (10), and its end area (16) at the projectile end is connected to a composition aid (17), which is arranged transversely with respect to the longitudinal axis (100) of the cartridge (1) and whose edge area (19), which is flat, is connected in a force-fitting and/or interlocking manner at the end to the casing sheath (8) and/or to the casing cover (7). In accordance with a third embodiment of the present invention, the first embodiment or the second embodiment is further modified so that the composition aid (17) is in the form of a cap and has a hemispherical outward bulge (18), which extends in the direction of the projectile part (3), and a flat edge area (19) that surrounds the outward bulge (18), wherein the internal diameter of the outward bulge (18) corresponds to the internal diameter of the container (14), which is in the form of a sack.

In accordance with a fourth embodiment of the present invention, the third embodiment is further modified so that the composition aid (17) has at least two opposite recesses (25) in the form of slots in the junction area between the outward bulge (18) and the flat edge area (19), through which recesses (25) two front areas (23, 24), which are in the form of tabs and are axially separated from one another, of the end area (16) at the projectile end of the container (14), which is in the form of a sack, are passed and are connected in an force-fitting manner at the front end to the outward bulge (18). In accordance with a fifth embodiment of the present invention, the third embodiment is modified so that the two areas (23, 24), which are in the form of tabs, of the container (14), which is in the form of a sack, are knotted to one another. In accordance with a sixth embodiment of the present invention, the third embodiment is modified so that the areas (23, 24), which are in the form of tabs, are adhesively bonded to the outward bulge (18) on the composition aid (17).

In accordance with a seventh embodiment of the present invention, the first embodiment, the second embodiment, the third embodiment, the fourth embodiment, the fifth embodiment, and the sixth embodiment, are modified so that the composition aid (17) is composed of a plastic that can be sprayed. In accordance with an eighth embodiment of the present invention, the first embodiment, the second embodiment, the third embodiment, the fourth embodiment, the fifth embodiment, the sixth embodiment, and the seventh embodiment are modified so that the end attachment of the composition aid (17) is provided in the junction area between the casing sheath (8) and the casing cover (7). In accordance with a ninth embodiment of the present invention, the first embodiment, the second embodiment, the third embodiment, the fourth embodiment, the fifth embodiment, the sixth embodiment, the seventh embodiment, and the eighth embodiment, are modified so that the container (14), which is in the form of a sack, is composed of cotton fabric.

The invention is essentially based on the idea of centering the propellant charge powder in the composition space, both radially and in the axial direction, of the cartridge. However, the aim in this case is to be less reliant on fillers, or composition disks, as a composition aid and, in fact, to use a type of powder sack or bag that holds and centers the propellant charge. Fillers have the disadvantage that, if they are composed of expanded polystyrene, they develop hydrochloric acid on combustion in the barrel, or, if composed of wadding, can become attached to the fin assembly after firing. The use of composition disks also results in the disadvantage that the disks must be attached by means of adhesive.

Bag charges for holding propellant charges are known per se, in particular, for modular propellant charges. However, their purpose and design, etc., are based on factors other than those proposed here. The propellant bag charges are supplied to a weapon system separately from a projectile, as is evident, inter alia, from DE 198 21 050 A1. DE 198 52 360 C2 discloses the arrangement of these bag charges in a weapon barrel. A method and an apparatus for handling propellant charges, which can be combined, are disclosed in DE 697 21 037 T2.

DE 72 34 535 U1 discloses a propellant charge casing in the form of a folding bag. This structure reproduces the shape of the casing and is folded up over the propellant charge with which it has been filled, is welded, and is pushed into the casing mouth.

According to the present invention, a (stretched) container (powder sack), which is in the form of a sack, and is, in each case, completely filled with the appropriate amount of propellant charge powder is arranged in the propellant charge casing proposed here, such that the container—and therefore also the propellant charge powder—extends in the direction of the central longitudinal axis of the cartridge, in which case the longitudinal axis is simultaneously the axis of symmetry of the container, which is in the form of a sack.

In a further development of the present invention, the end area at the base end of the container, which is in the form of a sack, is likewise attached to the casing base of the propellant charge casing by means of a spring plate, and the end area at the projectile end of the container, which is in the form of a sack, is attached to a composition aid, which is preferably composed of a plastic that can be sprayed, and extends at right angles to the longitudinal axis of the cartridge, and whose external circumference is connected in a force-fitting and/or interlocking manner to the casing sheath and/or to the casing cover of the propellant charge casing. The bag is thus stretched, and forms a type of inner casing.

In one advantageous embodiment of the invention, the composition aid is in the form of a cap and has a hemispherical outward bulge, which extends in the direction of the projectile part. The composition aid is axially adjacent to the container (which is in the form of a sack), and has a flat edge area that surrounds the outward bulge and is connected in an interlocking and/or force-fitting manner at the end to the casing sheath and/or to the casing cover.

In order to attach the container, which is in the form of a sack, to the composition aid, at least two opposite recesses, in the form of slots, are advantageously provided in the junction area between the hemispherical outward bulge and the flat edge area, through which recesses two front areas, which are in the form of tabs and are axially separated from one another, of the container (which is in the form of a sack) are passed and are connected to the spherical outward bulge at the front end. In this case, the two end areas, which are in the form of tabs, of the container (which is in the form of a sack) can be knotted to one another, or can be adhesively bonded to the hemispherical outward bulge.

It has been found to be particularly advantageous for the end attachment of the composition aid to be provided in the junction area between the casing sheath and the casing cover, because the composition disk then also assists the durability of the connection between the casing sheath and the casing cover. The composition aid can itself be integrated in the propellant charge casing, and snaps into the casing cover. It is used as an interlock between the casing and the casing cover, both of which are held firmly by a plug, or the like. The bag can be filled from the top or bottom. The casing cover, preferably composed of a plastic, has at least one guide band with weak points as well as undercuts, behind which the composition aid can snap in.

Alternatively, according to the object of the invention, centering can be achieved by a further casing (i.e., second casing sheath) provided with a narrower diameter than the projectile casing. The second narrower casing is, in this case, intended for the propellant charge. The constant diameter improves the internal ballistics.

BRIEF DESCRIPTION OF THE INVENTION

Further details and advantages of the invention will become evident from the following exemplary embodiments, which are illustrated with reference to figures, in which.

DETAILED DESCRIPTION OF THE INVENTION

Figure 1:
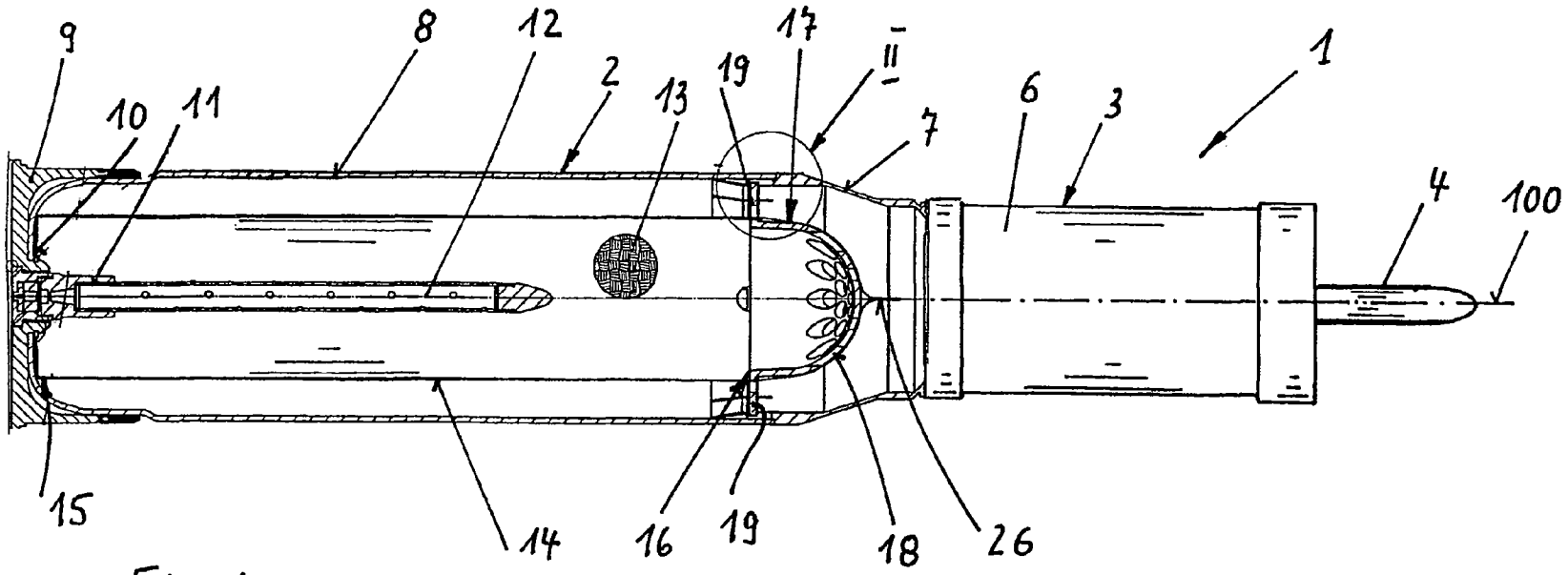
FIG. 1 shows a longitudinal section through a first exemplary embodiment of a cartridge, according to the present invention, provided with a container that holds propellant charge powder and is in the form of a sack, and a composition aid that has a hemispherical outward bulge.

In FIG. 1, 1 denotes a practice cartridge according to the invention, which has a propellant charge casing 2 and a discarding sabot projectile 3 that is attached to the propellant charge casing 2 at the front end of the propellant charge chasing 2. The discarding sabot projectile 3 essentially comprises a sub-calibre penetrator 4 provided with a conical fin assembly (not illustrated) and a discarding sabot 6 (a guide sabot).

The propellant charge casing 2 comprises a casing cover 7, a relatively thin casing sheath 8 that is composed of combustible material, and a casing base 9, which is composed, for example, of steel. The casing sheath 8 is attached in a manner known per se to a central projection 11 on the casing base 9 by means of a spring plate 10 and a locking ring (not illustrated). A propellant charge igniter 12, which is known per se and extends axially into the interior of the propellant charge casing 2, is likewise connected to this projection 11.

According to the invention, the propellant charge powder 13, which is located in the propellant charge casing 2, is arranged in a container 14 that is in the form of a sack and is composed of a cotton fabric, and extends in the direction of the longitudinal axis 100 of the practice cartridge 1, and whose end area 15 at the base end is likewise attached to the casing base 9 by means of the spring plate 10, so that the container 14 also contains the propellant charge igniter 12.

Figure 2:
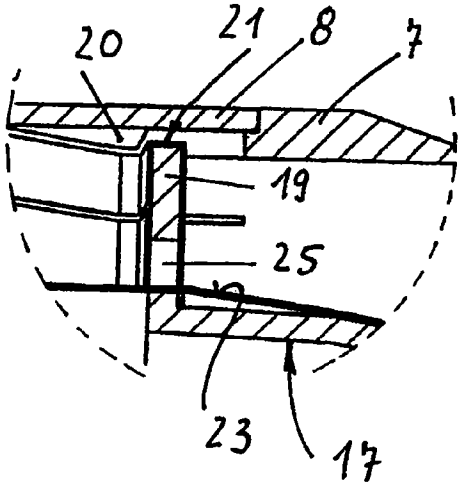
FIG. 2 shows an enlarged detail of the area annotated II in FIG. 1.

The end area 16, at the projectile end of the container 14 that is in the form of a sack, is in contrast attached to a composition disk 17 composed of plastic. Centrally, the composition disk 17 has a hemispherical outward bulge 18 whose diameter corresponds to the diameter of the container 14, which is in the form of a sack, and has a flat edge area 19 that surrounds this outward bulge 18. At the end, the edge area 19 is connected in an interlocking manner to the propellant charge casing 2 in the junction area between the casing sheath 8 and the casing cover 7, and provides axial and radial centering for the container 14, which is in the form of a sack, and the propellant charge powder 13 located in the container 14. As can be seen from FIG. 2, at the rear end of the casing cover 7, the casing cover 7 has undercuts 20 that grip behind the edge area of the composition disk 17 when the casing cover 7 is pushed onto the casing sheath 8, thus fixing the composition disk 17 in the space 21 in front of the casing cover 7.

Figure 3:
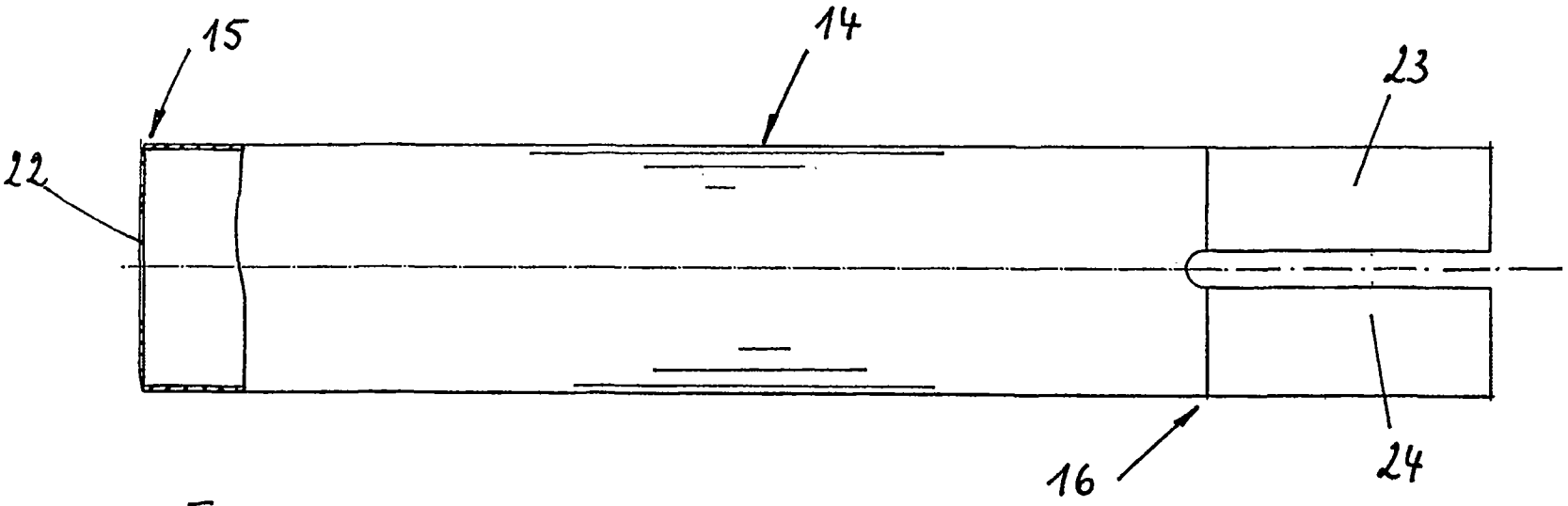
FIG. 3 shows a side view of a container, which is in the form of a sack, and is illustrated enlarged, before being fitted into the cartridge.
Figure 4:
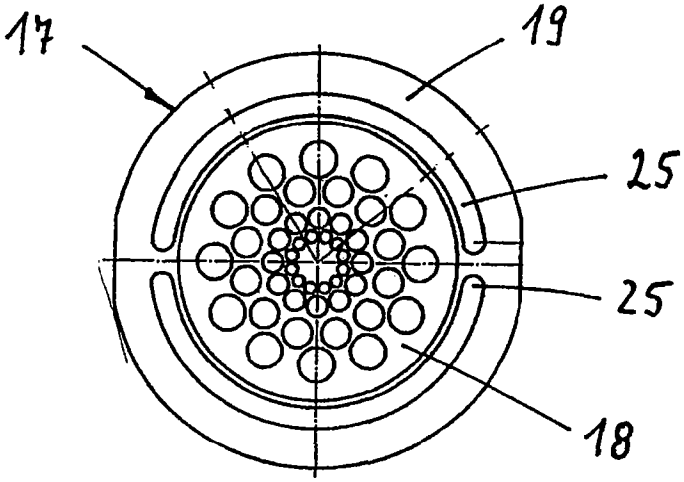
FIG. 4 shows a front view of a composition aid, likewise before it is fitted into the cartridge according to the present invention.

FIG. 3 shows the container 14, which is in the form of a sack, before its mounting within the propellant charge casing 2. On its end area 15, at the base end, the container 14 has an opening 22, by means of which the container 14 is pushed onto the projection 11 on the casing base 9, and is then attached by means of the spring plate 10. The end area 16, at the projectile end of the container 14 that is in the form of a sack, is axially separated, thus resulting in two separate areas 23, 24, which are in the form of tabs. These areas 23, 24, which are in the form of tabs, are each passed through a recess 25, which is in the form of a slot, in the composition disk 17, wherein these recesses 25 are arranged between the hemispherical outward bulge 18 and the flat edge area 19, and are each approximately sickle-shaped (See FIG. 4).

In order to attach the container 14, which is in the form of a sack, to the composition disk 17, the two areas 23, 24, which are in the form of tabs, can be knotted to one another (indicated as the pointed area 26 in FIG. 1). However, it is also possible for the areas 23, 24, which are in the form of tabs, to be adhesively bonded to the composition disk 17 at the front end.

The space for the propellant charge powder 13, created in this way in the container 14 (which is in the form of a sack), is essentially dependent on (i) the diameter of the spring plate 10 that is used, (ii) the size of the recesses 25 (which are in the form of slots) in the composition disk 17, (iii) the fixed axial position of the composition disk 17 within the propellant charge casing 2, and (iv) the shape of the composition disk 17, and can therefore be varied within wide limits depending on the amount of propellant charge powder to be used.

Figure 5:
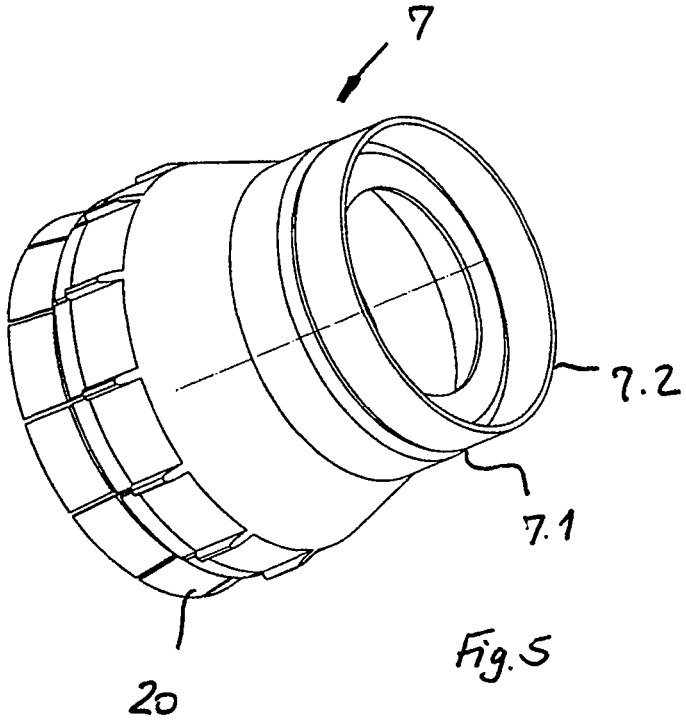
FIG. 5 shows a perspective illustration of the casing cover shown in FIG. 1.

FIG. 5 shows the casing cover 7 (also called a "casing cap") in the form of a perspective illustration. The casing cover 7 has sharp-edged weak points 7.1, as well as a circumferential neck 7.2, on which the discarding sabot 6 acts.

The present invention is, of course, not restricted to the exemplary embodiment described above. For example, the composition disk may also have merely a shape in the form of a disk or else, for example, may have a parabolic outward bulge. Furthermore, the composition disk can be mounted in the area between the casing sheath 8 and the casing cover 7 by means of different interlocking and/or force-fitting connections with which a person skilled in the art will be familiar.

LIST OF REFERENCE SYMBOLS

1 Cartridge, practice cartridge
2 Propellant charge casing
3 Discarding sabot projectile, projectile part
4 Penetrator
6 Discarding sabot (guide sabot)
7 Casing cover
7.1 Weak points
7.2 Circumferential neck
8 Casing sheath
9 Casing base
10 Spring plate
11 Projection
12 Propellant charge igniter
13 Propellant charge powder
14 Container in the form of a sack
15 End area of the container at the base end
16 End area of the container at the projectile end
17 Composition aid (disk)
18 (Hemispherical) outward bulge
19 Edge area of the composition disk
20 Undercuts
21 Space
22 Opening of the container
23, 24 Areas of the container in the form of tabs
25 Recess of the composition disk in the form of a slot
26 Pointed area
100 Longitudinal axis of the practice cartridge

The invention claimed is:

1. A cartridge having:

(a) a propellant charge casing that is at least partially filled with propellant charge powder; and (b) a projectile part connected to the propellant charge casing at a front end of the propellant charge casing, wherein the propellant charge casing has i. a casing cover;

ii. a casing sheath; and iii. a casing base, wherein the casing sheath is connected on one end via the casing cover to the projectile part and the casing sheath is connected on another end via a spring plate to the casing base, and the propellant charge powder is arranged in a container that is in the form of a sack and extends in a direction of a longitudinal axis of the cartridge.

2. The cartridge as claimed in claim 1, wherein a first end area located at a base end of the container is attached to the casing base by the spring plate, and a second end area located at a projectile end of the container is connected to a composition aid that is arranged transversely with respect to the longitudinal axis of the cartridge, and an edge area of the composition aid is flat, and is connected in a force-fitting manner, or in an interlocking manner, or in a force-fitting and interlocking manner, at a junction area to the casing sheath, or to the casing cover, or to the casing sheath and the casing cover.

3. The cartridge as claimed in claim 2, wherein the composition aid is in the form of a cap and has a hemispherical outward bulge that extends in a direction of the projectile part, and a flat edge area of the composition aid surrounds the outward bulge, wherein an internal diameter of the outward bulge corresponds to an internal diameter of the container.

4. The cartridge as claimed in claim 3, wherein the composition aid has at least two opposite recesses formed therein in the form of slots in the junction area between the outward bulge and the flat edge area, wherein through the recesses two front areas of the second end area of the container pass, wherein the two front areas are in the form of tabs and are axially separated from one another at the projectile end of the container, and the two front areas are connected in an force-fitting manner at a front end of the compositional aid to the outward bulge.

5. The cartridge as claimed in claim 4, wherein the two front areas of the container are knotted to one another.

6. The cartridge as claimed in claim 3, wherein the two front areas are adhesively bonded to the outward bulge on the composition aid.

7. The cartridge as claimed in claim 2, wherein the composition aid is made of a plastic, and the plastic is a sprayable plastic.

8. The cartridge as claimed in claim 2, wherein an end attachment of the composition aid is provided in the junction area between the casing sheath and the casing cover.

9. The cartridge as claimed in claim 1, wherein the container comprises cotton fabric.

* * * * *